United States Patent [19]

Kienhöfer

[11] Patent Number: 4,960,232

[45] Date of Patent: Oct. 2, 1990

[54] ARM BAND

[75] Inventor: Gerhard Kienhöfer, Birkenfeld, Fed. Rep. of Germany

[73] Assignee: Firma Gerhard D. Wempe KG, Hamburg, Fed. Rep. of Germany

[21] Appl. No.: 277,001

[22] Filed: Nov. 28, 1988

[30] Foreign Application Priority Data

Apr. 25, 1988 [DE] Fed. Rep. of Germany ... 8805454[U]

[51] Int. Cl.[5] ..... A44C 5/12

[52] U.S. Cl. ..... 224/179; 63/3

[58] Field of Search ..... 224/164–179; 63/21, 22, 3, 32; 368/282; 59/80, 82, 84

[56] References Cited

U.S. PATENT DOCUMENTS

| | | | |
|---|---|---|---|
| 1,201,262 | 10/1916 | Cox | 63/3 |
| 1,663,791 | 3/1928 | Boot et al. | 224/253 |
| 1,778,726 | 10/1930 | Pappert | 63/3 |
| 1,849,741 | 3/1932 | Doppenschmitt | 63/3 |
| 1,933,576 | 11/1933 | Weed | 63/3 |
| 1,935,504 | 11/1933 | Hargreaves | 63/3 |
| 2,758,763 | 8/1956 | Cornu | 224/179 |
| 2,986,313 | 5/1961 | Swecker, Jr. | 224/171 |

FOREIGN PATENT DOCUMENTS

| | | | |
|---|---|---|---|
| 517749 | 2/1940 | United Kingdom | 224/176 |

*Primary Examiner*—Linda J. Sholl

*Attorney, Agent, or Firm*—Michael J. Striker

[57] ABSTRACT

An arm band, particularly a watch arm band comprises a holder provided on its front side and a holder on its rear side, the holders having a U-shaped cross-section, a plurality of webs connecting the holders with one another, and a band exchangeably accommodated between the holders and arranged so that end portions of the band extend in the U-shaped holders and a lower side of the band abuts against the webs.

18 Claims, 1 Drawing Sheet

FIG. 1
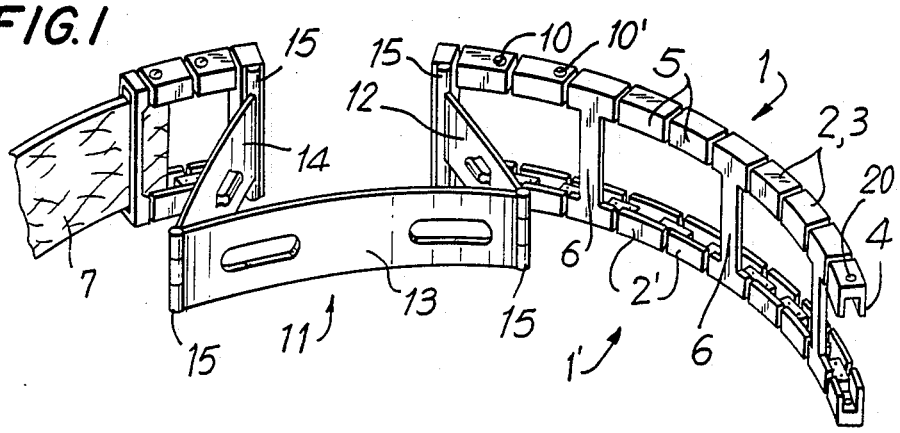
FIG. 2
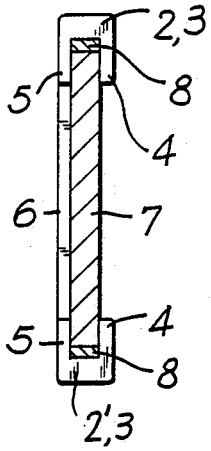
FIG. 3
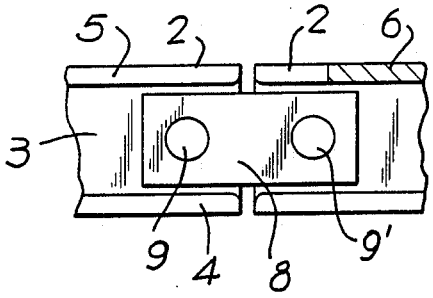
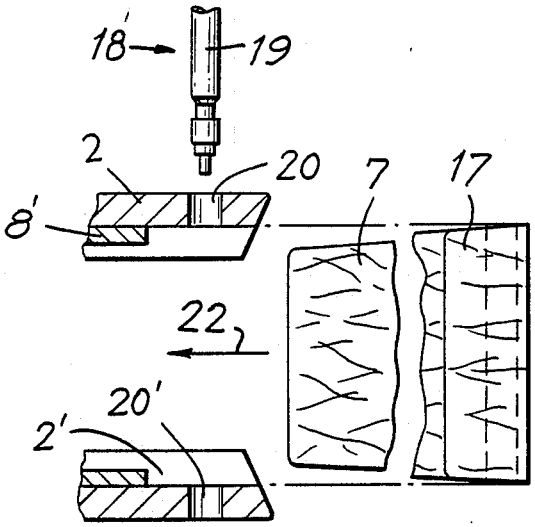
FIG. 4

ARM BAND

BACKGROUND OF THE INVENTION

The present invention relates to an arm band, in particular a watch arm band.

Watch arm bands are known for wearing a watch, which are composed of metal, such as steel or gold, of fabric, of leather, and of a combination of these materials. As a rule, these watch arm bands are designed so that their outer appearance is not variable, therefore cannot satisfy changing taste requirements when needed.

SUMMARY OF THE INVENTION

Accordingly, it is an object of the present invention to provide a watch arm band in which its substantial components which provide an outside impression are exchangeable, so as to adjust to different taste requirements in shape and color of the arm band.

In keeping with these objects and with others which will become apparent hereinafter, one feature of the present invention resides, briefly stated, in an arm band which includes U-shaped holders provided on a front side and a rear side and connected with one another by webs, so that a leather band can be exchangeably accommodated between the holders with its end portions extending in the U-shaped holders and its lower side abutting against the webs.

In arm band of the construction in accordance with the present invention, an initially available leather band accommodated in a support which is not special in a technical and custom sense, can be replaced with another band with a different color, shape or material, so as to follow respective fashions, to be adjusted to specific events, occurrences or public meetings, etc. In the inventive arm band there is a possibility to exchange a leather band of a predetermined color with a band of another color. For example a band of nappa leather can be exchanged with a band of an alligator leather or another surface structure leather. Moreover, a different band, for example of silver or gold, or a band of another material than leather can be installed in the arm band.

The arm band can also be designed as a fixed arm bracelet which is open or openable for inserting the exchangeable band from one end.

When the arm band is formed as a watch arm band it is advantageous when it is subdivided into a plurality of links so as to provide a flexibility and to arrange it around the hand joint firmly. The above mentioned holders of the arm band are subdivided into links which are pivotally connected with one another. The hinges for the links can be formed as bars which are arranged on the inner side of the central webs of two neighboring links and connected with their ends with the links, for example by riveting.

The legs of the U-shaped links on the outer side can be provided with projections. These projections can form additional holders for the exchangeable leather bands or supports for the same, and also contribute to an advantageous decorative appearance.

Instead of the projections or in addition to them, the legs of the U-shaped holders located on the outer side can be connected with one another by supports which are arranged at a distance from one another. These supports in addition to the guidance of the leather band, can support one or several jewelry stones, for increasing the total appearance of the arm band.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a perspective partial view of an arm band in accordance with the present invention, composed of a plurality of links;

FIG. 2 is a cross-section of the arm band in accordance with the present invention shown in FIG. 1;

FIG. 3 is a side view of two neighboring links of the inventive arm band;

FIG. 4 is a view showing the details of the end portion of an arm band in accordance with the present invention;

FIG. 5 is a partial plan view of a watch arm band of the present invention; and FIG. 6 is a perspective view of the arm band which is formed as an arm bracelet in accordance with the present invention.

DESCRIPTION OF THE PREFERRED EMBODIMENT

A watch arm band shown in FIGS. 1 - 5 is composed of two holders 1 and 1'. The front holder 1 lies on the edge side which faces the hand of a user, while the rear holder 1' lies on the opposite side.

The holders 1 and 1' are subdivided into individual links 2 and 2' which are pivotally connected with one another. The links 2 and 2' are arranged in alternating order and can be composed of gold or steel.

The individual links 2 and 2' have a U-shaped cross-section. In each link a leg 4 which is located outside during wearing of the arm band and is connected through a central web 3 with a leg 5 which is located inwardly on the arm, so as to form therebetween a distance for receiving a leather band 7.

For maintaining a predetermined distance between the holders 1 and 1', the webs 6 are provided. They are arranged at a distance relative to one another and connect the inner legs 5 of the individual links 2 and 2'. The webs 6 have different lengths since a converging course of the holders 1 and 1' in direction toward a lock 11 on the arm band is provided for facilitating the insertion of a leather band 7 at a side opposite to the lock 11. The individual links 2 and 2' are pivotally connected with one another by bars 8 each connecting two links. The bars 8 are held by rivets 9 and 9' on the inner side of the central web 3, in a pivotal manner on both ends.

The lock 11 is formed as a so-called double-walled lock. The links 2 and 2' which are adjacent to the lock 11 are provided with screws 10 and 10' which are accessible from outside. Thereby these links can be released from the arm band and the arm band can be shortened when it is necessary to adjust the arm band to the hand joint of the user.

The lock 11 includes three brackets 12, 13, 14. The brackets are connected with one another by hinges 15, and also connected at both ends to two arm band halves in a known manner.

The other links 2 and 2' of the holders are provided with throughgoing openings 20 and 20' for a spring pin 18. The spring pin extends through a loop 17 which is arranged on one end of the leather band 7 and is mounted with its free end pin 19 on an arm 31 of a watch 30.

For producing this connection, the leather band 7 is inserted between both holders 2 and 2' in direction of the arrow 22 as shown in FIG. 4, until the loop 17 lies between the throughgoing openings 20 and 20'. Then the spring pin 18 can be inserted through the opening 20, the loop 17 and the opening 21 for anchoring in a blind hole of the arm 31 of the watch 30 with its freely extending pin 19 which is under the pressure of a not shown spring.

The band 7 which can be formed exchangeable for example of a gold fabric or another material than leather, supported on its inner side by the web 6. It also can be held on its outer side by additionally provided supports 32 or only by projecting portions 28. The portions 28 are suitable for receiving jewelry stones 33, such as for example precious stones or diamonds, and further ornamental decoration of the arm band in accordance with the taste of the user. Such precious stones can also be arranged directly on the links 2 and 2'.

In deviation from the above described embodiment, FIG. 6 shows not a watch arm band but an open arm bracelet 35 with holders which are not subdivided between the individual links. Instead, the holders have a cross-section with U-shaped profile and are connected with one another by supports 32 and webs 6 for holding and guiding an exchangeably arranged band 7.

It will be understood that each of the elements described above, or two or more together, may also find a useful application in other types of constructions differing from the types described above.

While the invention has been illustrated and described as embodied in an arm band, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arm band, particularly a watch arm band, comprising a holder provided on its front side and a holder on its rear side, said holders having a U-shaped cross-section; a plurality of webs connecting said holders with one another; a band exchangeably accommodated between said holders and arranged so that end portions of said band extend in said U-shaped holders and a lower side of said band abuts against said webs, each of said holders being subdivided into a plurality of links which are pivotally connected with one another, each of said links having a U-shaped cross-section having two legs and a central web connecting said legs with one another; and means for pivotally connecting at least some of said links with one another, said connecting means including a plurality of bars each having two ends and each pivotally connecting said central webs of two of said links, each of said bars having two ends each pivotally connected to a respective one of said two links by a rivet extending perpendicular to planes of said bars and said central webs of said links.

2. An arm band as defined in claim 1, wherein each of said holders is subdivided into a plurality of links which are pivotally connected with one another; and further comprising means for pivotally connecting said links with one another.

3. An arm band as defined in claim 2, wherein each of said links has a U-shaped cross-section having two legs and a central web connecting said legs with one another, said connecting means including a plurality of bars each having two ends and each connecting said central webs of two of said links.

4. An arm band as defined in claim 3, wherein each of said bars has two ends each connected to a respective one of said two links by riveting.

5. An arm band as defined in claim 1, wherein said links also include two links arranged at an end of the arm band and each provided with a throughgoing opening, said band having two loops; and further comprising spring pins each having an end pin extending through said throughgoing opening of a respective one of said two links and into a respective one of said loops of said band.

6. An arm band as defined in claim 1, wherein said links include two links arranged at an end of the arm band and each having an opening in said central web; and further comprising a screw extending through said opening of said central web with each of said two links into respective ones of said bars.

7. An arm band as defined in claim 1, wherein said legs include outer legs located at an outer side of the arm band and provided with a plurality of projections.

8. An arm band as defined in claim 1, wherein said legs include outer legs located at an outer side of the arm band; and further comprising a plurality of supports which connect said outer legs with one another and arranged at a distance from one another.

9. An arm band as defined in claim 7, wherein at least some of said projections are each provided with at least one jewelry stone.

10. An arm band as defined in claim 8, wherein at least some of said supports are each provided with at least one jewelry stone.

11. An arm band as defined in claim 2 wherein at least some of said links are provided with at least one jewelry stone.

12. An arm band as defined in claim 1, wherein said links are composed of different materials and arranged alternatingly with one another.

13. An arm band as defined in claim 12, wherein said links are composed of steel and gold and arranged alternatingly with one another.

14. An arm band as defined in claim 1, wherein said holders and said webs are subdivided into two identical halves so that the arm band includes two halves, each of said halves having one end connectable with the watch and another end connectable with a lock.

15. An arm band as defined in claim 14 and further comprising a lock having two ends each connected to the other end of a respective one of said halves.

16. An arm band as defined in claim 1, wherein said holders have ends and a shape converging towards said ends.

17. An arm band as defined in claim 1, wherein said holders and said webs together form an arm bracelet.

18. An arm band, particularly a watch arm band, comprising a holder provided on its front side and a holder on its rear side, said holders having a U-shaped cross-section; a plurality of webs connecting said holders with one another; a band exchangeably accommodated between said holders and arranged so that end portions of said band extend in said U-shaped holders and a lower side of said band abuts against said webs, each of said holders being subdivided into a plurality of links which are pivotally connected with one another, each of said links having a U-shaped cross-section having two legs and a central web connecting said legs with one another; and comprising means for pivotally connecting at least some of said links with one another, said connecting means including a plurality of bars each having two ends and each pivotally connecting said central webs of two of said links.

* * * * *